United States Patent [19]

Stewart

[11] 4,245,793

[45] Jan. 20, 1981

[54] DRAW OFF CONTROL SYSTEM FOR A ROLL OF MATERIAL

[75] Inventor: John Stewart, West Horsley, England

[73] Assignee: Twiflex Couplings Limited, Middlesex, England

[21] Appl. No.: 60,122

[22] Filed: Jul. 24, 1979

[30] Foreign Application Priority Data

Jul. 27, 1978 [GB] United Kingdom ..... 31288/78

[51] Int. Cl.[3] ..... B65H 25/22

[52] U.S. Cl. ..... 242/75.43

[58] Field of Search ..... 242/75.43, 75.49, 75.4; 226/38, 44

[56] References Cited

U.S. PATENT DOCUMENTS

| | | | |
|---|---|---|---|
| 2,343,181 | 2/1944 | Heinz | 242/75.43 |
| 2,925,963 | 2/1960 | Gelleke | 242/75.43 |
| 2,974,893 | 3/1961 | Aaron | 242/75.43 |
| 4,000,865 | 1/1977 | Gaskins | 242/75.43 |

*Primary Examiner*—Edward J. McCarthy

*Attorney, Agent, or Firm*—Cushman, Darby & Cushman

[57] ABSTRACT

The disclosure relates to a draw off control system for a roll of material in which a pivoted arm carries one end of a roller around which the material is passed to pull the arm in one direction, the arm being counterbalanced by a pneumatically operated thruster having a plunger acting on the arm. The force provided by the thruster varies with projection of the plunger so that as the material tension varies over a certain range the arm will move to establish a new equilibrium position. Movement of the arm in one direction with falling tension is arranged to apply a brake to the feed roller of the material when the arm moves beyond a certain position, the brake is applied to increase tension, the brake being released when the arm returns past said position.

12 Claims, 3 Drawing Figures

DRAW OFF CONTROL SYSTEM FOR A ROLL OF MATERIAL

FIELD OF THE INVENTION

This invention relates to a draw off control system for a roll of material for example for controlling web tension in unwind stands, pay-off reels, or generally where it is desired to maintain a substantially constant tension in a sheet or strip of material being uncoiled from a circular roll. The 'web' may be paper, plastic, metal or any material having sufficient flexibility to be handled in this way.

Known tension controllers commonly use a control means in which the web is caused to be deflected from a straight path by a roller so constrained as to apply a load to some form of pressure transducer, the load bearing an approximately proportional relationship to the web tension. The signal so generated is compared to a pre-set value and the error used to apply corrective action to the tensioning means, often a form of brake fitted to the shaft upon which the uncoiling reel is mounted.

Disadvantages of such devices are that the tension sensing means generally requires the measurement of a force proportional to the web tension, so that the error signal is produced as a small difference in large quantities with consequent inherent tendency to error, and in the relative complexity of the error signal amplifier which controls the tensioning means.

SUMMARY OF THE INVENTION

The invention provides a draw off control system for a roll of material, the system comprising a force generating device having a movable force applying member and being capable of generating and applying a force through the member which diminishes with movement of the member in one direction and increases with movement of the member in the opposite direction, means responsive to tension in the material drawn off from a roll of material to apply a force in accordance with the tension to said member counter to the force generated by the device, means for increasing and decreasing tension in the material drawn off from the roll, a control for that device operable to increase the tension with movement of the member beyond a certain position in said one direction and operable to reduce tension on movement of the member beyond said certain position in the opposite direction and means to adjust the force applied by the force generating device to the force applying member so that the member is in equilibrium between the force generated and the force applied by the tension responsive means when the member is in said certain position.

The force generating device may comprise an air pressure responsive device and the force applying member is moved by the device in response to air pressure, the device being such that, with a constant air pressure, movement of the member in one direction is accompanied by a reduction in the force imparted to the member and movement in the opposite direction is accompanied by an increase in the force, the device having means for connection to an air pressure supply and means for adjusting the level of air pressure so that the force applying member can be set in equilibrium with the tension responsive means at said certain position of the member.

More specifically the pressure responsive device comprises a chamber across which a diaphragm extends to which the force applying member is connected, one side of the chamber having said means for connection to an air pressure supply and the other side of the chamber having a convergent wall with which the diaphragm progressively engages from its outer periphery as the diaphragm is deflected into that part of the chamber to reduce progressively the effective area of the diaphragm and therefore the force applied by the diaphragm to the force applying member as the diaphragm is deflected into that part of the chamber.

In any of the above arrangements the control for the tension increasing/decreasing means comprises an air valve opened by movement of the force applying member through said certain position in one direction and closed by movement of the force applying member in the opposite direction, the air valve controlling the means for increasing/decreasing tension in the material drawn off from the roll.

An air pressure supply may be connected to the valve and to a control unit for the means to increase/decrease tension, the valve is opened to atmosphere by movement of the force applying member in said one direction beyond the certain position and is closed to maintain air pressure in the circuit when the force applying member moves in the opposite direction beyond said certain position, the control unit being arranged to cause an increase in the tension when air pressure is released from the circuit and to cause a decreaase in the tension when air pressure is maintained in the circuit.

DESCRIPTION OF THE PREFERRED EMBODIMENT

Figure 1:
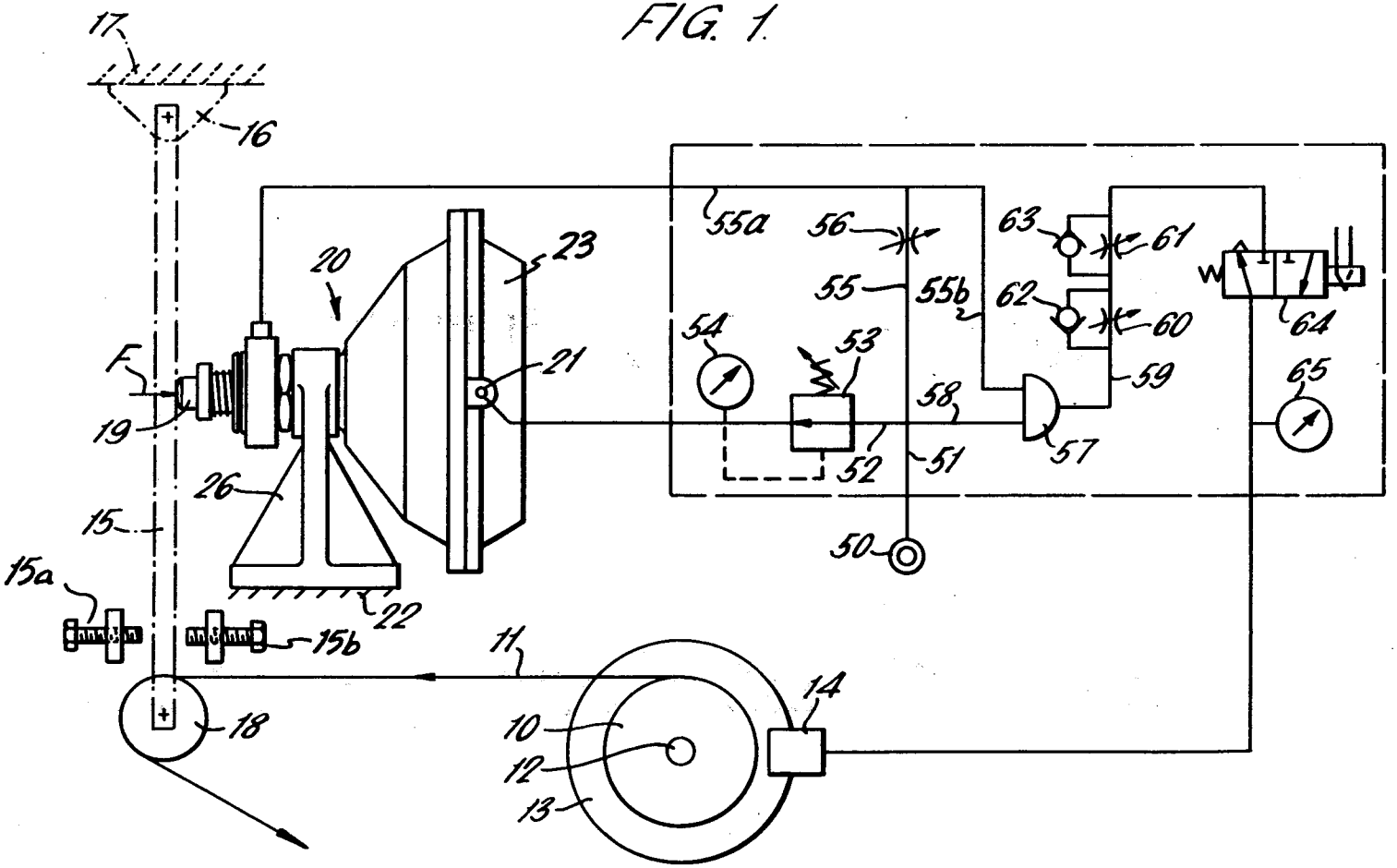
FIG. 1 is a diagrammatic view of a control system for controlling draw-off of a material from a roller.

Referring to the drawings, there is shown a reel 10 on which web material 11 is wound. The reel 10 is mounted on an axle 12 supported in conventional bearings for rotation. The axle has a brake disc 13 fixed thereto to rotate with the axle and a pneumatically operated caliper brake 14 is mounted to embrace the periphery of the disc to apply a braking force to the disc and thereby control the tension in the web drawn off from the reel.

Adjacent reel 10 there is a roller 18 around which the web 11 is passed, one end of the roller being mounted for rotation in a fixed bearing carrier (not shown) and the other end being rotatably mounted at one end of a swinging arm 15, the other end of which is pivoted on a lug 16 mounted on a fixed part of the support structure 17. Pivotal movement of the arm 15 is limited in either direction by adjustable stops 15*a* and 15*b*.

The web may be passed around an intermediate roller (not shown) between the reel 10 and roller 18 to provide a constant "wrapping" angle with the reel 10 and then passes around the roller 18 so that tension in the web 11 acts to draw the roller 18 and with it the pivoted arm 15 in one direction around the pivot axis of the arm. That movement is resisted by the action of a plunger 19 which projects from an air thruster 20, the plunger 19 engaging the arm 15 approximately midway along the length of the arm. The air thruster assembly 20 is mounted on a bracket 21 fixed to a rigid part of the structure 22.

Figure 2:
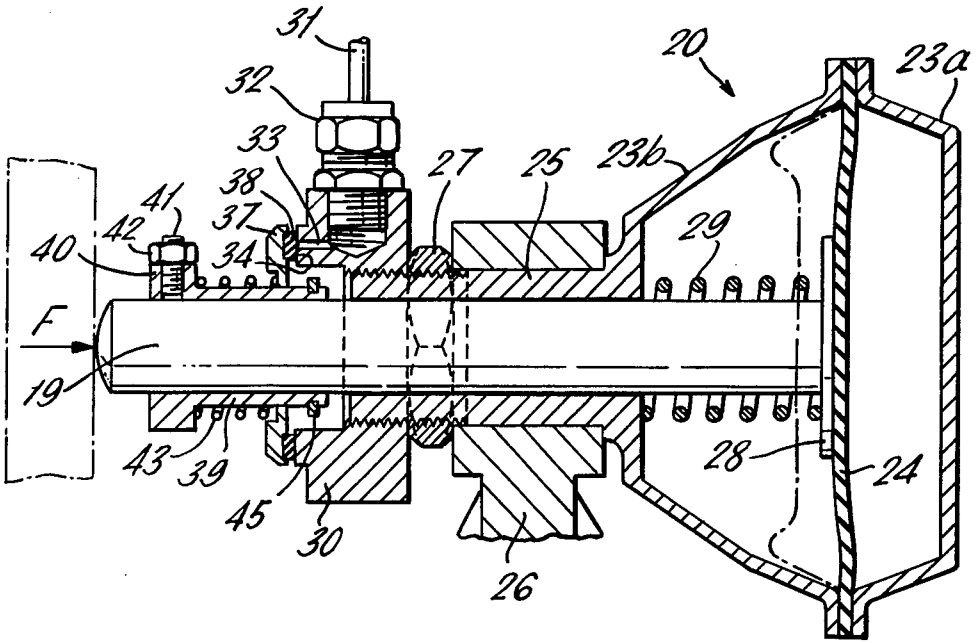
FIG. 2 is a sectional view showing part of the system in detail.

The air thruster 20 will now be described in greater detail with particular reference to FIG. 2 of the drawings. The air thruster comprises a housing 23 formed in two parts, 23*a*, 23*b*, with a flexible diagram 24 extending across the housing and sandwiched around its periphery between the two parts of the housing. An air pressure supply is connected to the cavity in the part 23*a* of the housing as described later. The part 23*b* of the housing has a wall which converges as it extends away from the part 23*a* of the housing and terminates in a cylindrical extension 25 through which the aforementioned plunger 19 extends. The cylindrical extension 25 extends through an eye 26 formed on the mounting bracket 21 and the end of the extension has an external screw thread to receive a nut 27 which secures the housing to the eye.

The plunger 19 extends through the cylindrical extension 25 into the housing part 23*b* and is formed with a head 28 which bears against a central part of the diaphragm 24. A compression spring 29 acts between the head 28 of the plunger and the end of the cylindrical extension 25 to retract the plunger into the housing. Air pressure supplied to the housing part 23*a* will force the diaphragm 24 into the housing part 23*b* and in so doing the plunger 19 will be extended from the housing. At the same time, the diaphragm 24, starting from its outer periphery, is progressively brought into engagement with the convergent wall of the housing 23*b* as indicated in chain line in the drawing and so the effective area of the diaphragm 24 is progressively decreased. Thus, with constant air pressure supplied to the housing part 23*a*, the force acting on the plunger 19 will also be progressively decreased as the plunger is extended from the housing. Correspondingly, as the plunger retracts into the housing, the part of the periphery of the diaphragm in engagement with the housing wall will be progressively dis-engaged from the wall thus increasing the effective area of the diaphragm and thereby increasing the force applied to the plunger assuming that air pressure in the housing part 23*a* remains constant. The air supply system for the housing will be described in greater detail later.

An annular valve body 30 is screwed on to the end of the extension 25 adjacent the nut 27 and an air supply conduit 31 is connected to the valve body by union 32 to deliver air to a valve port 33 which opens into a side face 34 of the valve body disposed on the opposite side thereof to the extension 25. The valve port 33 is opened and closed by an annular valve plate 37 which carries a seal 38 to seal over the valve port 33. The valve plate 37 is slidably located on a sleeve 39 located on the plunger 19. The sleeve 39 has a collar 40 at the end adjacent the end of the plunger 19 and a grub screw 41 extends through the collar and is locked against the plunger 19 by a locking nut 42 to lock the sleeve to the plunger. A coil spring 43 acts between the collar 40 and the annular plate 37 so that when the spring is in compression, the plate is pressed to hold the seal against the side face of the valve body to close the valve port 33. The end of the sleeve 39 remote from the collar 40 has a circlip 45 secured thereto so that when the plunger is extended from the housing, it will eventually reach a certain position in which it engages the annular plate and lifts the seal away from the side face of the valve body thus opening the valve port 33.

Opening and closing of the valve port 33 is arranged to apply or release the aforesaid disc brake to tension or relieve the web being drawn off from the roller as will now be described with respect to the pneumatic circuit shown in FIG. 1.

An air pressure supply capable of supplying air at up to 100 lb/per square inch is indicated at 50. There is a main supply line 51 which has one branch 52 extending through a pressure regulator 53 to the housing part 23*a* of the air thruster. A pressure gauge 54 is provided between the regulator 53 and housing part 23*a* so that the pressure supply can be set at a required level. The pressure is adjusted in accordance with the nominal tension required in the web material being drawn off from the reel. This will be determined by the characteristics of the material concerned including its strength.

A second branch 55 from supply line 51 is connected to a flow restrictor 56 downstream of which the line 55 divides into one branch 55*a* which is connected to supply conduit 31 which leads to the valve body 30 and a second branch 55*b* which extends to the control side of a "NOT" unit 57. The "NOT" unit 57 is also connected to the main output line from the air supply line 51 by a branch 58 and a main output line 59. The latter extends through flow restrictors 60, 61 one of which has a by-pass valve 62 in one direction and the other of which has a by-pass valve 63 in the other direction and thence to the an on/off valve 64 and finally to the air pressure operated brake caliper 14 described earlier. A pressure gauge 65 is provided between the on/off valve 64 and the brake caliper to indicate the pressure in the line.

The system operates as follows:

The air thruster 20 is supplied with air at a pressure predetermined by the setting of the pressure regulator 53 and indicated on gauge 54. The air thruster plunger 19, urged forward against the lever 15 by this pressure, resists movement of the lever caused by tension in the web 11 and the air pressure is set so that the air pressure supplied to the brake 14 causes sufficient tension in the web 11 just to balance the thrust of the plunger 19 so that the arm 15 floats freely in a position between but not touching the spaced stops 15*a*, 15*b*. If the web tension remains constant, the arm 15 will remain stationary in equilibrium between the stops. If tension in the web 11 falls, the force applied by the air thruster to the plunger 19 will be greater than that applied by the lever to the plunger and so the plunger will force the lever away from the air thruster until the annular plate 35 is lifted away from the valve body thus opening the port 33 to permit air to escape from the port. The fall in pressure in the line 55*a* is communicated to the line 55*b* and the "NOT" unit 57 then opens the main air supply 58 to the line 59. The air passes through one way valve 62, restrictor 61 and the on/off valve 64 to the brake caliper 14 to apply the brake.

The application of the brake increases tension in the web 11 so that the force applied by the arm 15 to the plunger 19 increases and gradually the arm forces the plunger to retract into the housing until the seal 36 on the valve plate 35 is restored to the side of the valve body to close off the valve port 33. Air pressure in the line 55*a* then rises and the resulting rise in pressure in the branch 55*b* connected to the "NOT" unit 57 causes the unit to close the supply line 58 to the output line 59 and to open the output line direct to atmosphere. Air pressure previously supplied to the brake caliper can then exhaust through the on/off valve 64 back through one way valve 63 and restrictor 60 to atmosphere thus relieving the braking effect applied by the brake and reducing web tension. This cycle is repeated as web tension varies to maintain the tension at a mean level proportional to the air pressure supplied to the air thruster 20. It will be understood that by raising the air pressure supplied to the thruster the mean web tension will be increased and by lowering the air pressure supplied, the web will be reduced.

The speed of the response of the system is controlled by pre-setting the restrictors 60 and 61 to suit the characteristics of the web material and of the braking system which, it will be appreciated, vary widely according to the application. Brake pressure gauge 65 gives an indication of the brake torque variation which assists the setting of these restrictions.

The solenoid operated brake on/off valve 64 is set to the "off" position when starting the apparatus so that the brake is off when the reel 10 first begins to rotate; it is then moved to the on position to provide automatic tension to control once the web has started to be drawn off the reel.

Figure 3:
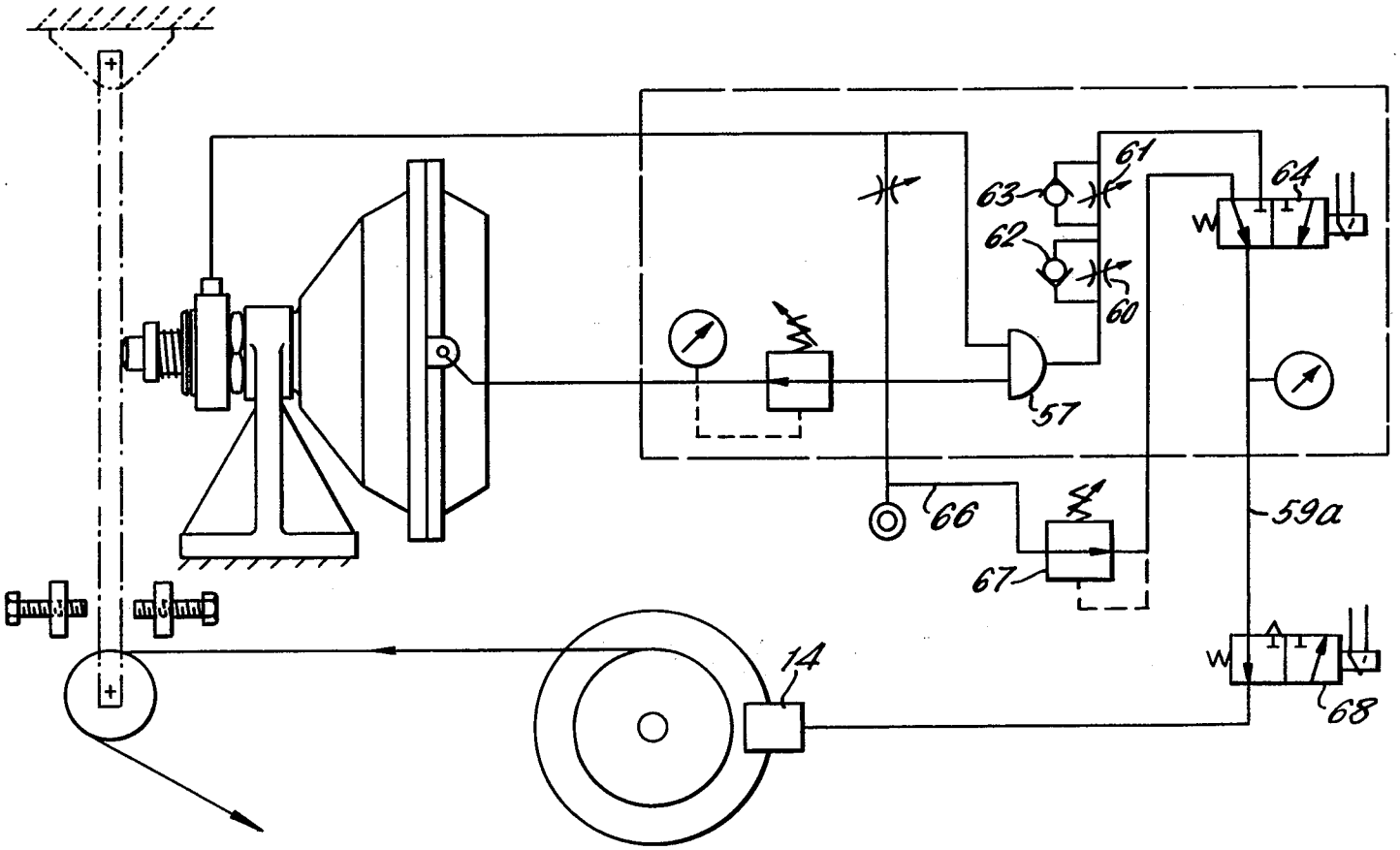
FIG. 3 is a similar view to that of FIG. 1 illustrating certain modifications.

Reference is now made to the modified arrangement illustrated in FIG. 3 of the drawings. The main air supply line 51 has a further branch 66 connected through an adjustable pressure regulator valve 67 and thence to the on/off valve 64 to a connection open to atmosphere in the previously described arrangement. The line 59*a* leading to the brake 14 from the valve 64 is connected to the line 66 when the valve 64 is in its "off" position (i.e. line 59 to the brake is closed) to actuate the brake. Pressure in line 66 is set by the regulator valve 67 to provide either emergency braking or a light braking to apply some tension to the web to assist in setting up the controller for operation.

An additional solenoid valve 68 can be provided on line 59 to connect brake 14 to atmosphere to release all braking when required for handling of the roll or changing over of rolls.

It will be understood that many further modifications may be made to the above described embodiment without departing from the scope of the invention. For example, the roller 18 may be supported between a pair of pivoted arms 15 with the thruster plunger acting on one of the arms.

I claim:

1. A draw-off control system for a roll of material, the system comprising a force generating device having a movable force applying member and being capable of generating and applying a force through the member which diminishes with movement of the member in one direction and increases with movement of the member in the opposite direction, means responsive to tension in the material drawn off from a roll of material to apply a force in accordance with the tension to said member counter to the force generated by the device, means for increasing and decreasing tension in the material drawn off from the roll, a control for that device operable to increase the tension with movement of the member beyond a certain position in said one direction and operable to reduce tension on movement of the member beyond said certain position in the opposite direction and means to adjust the force applied by the force generating device to the force applying member so that the member is in equilibrium between the force generated and the force applied by the tension responsive means when the member is in said certain position and the material is at the required tension.

2. A system as claimed in claim 1 wherein the force generating device comprises an air pressure responsive device and the force applying member is moved by the device in response to air pressure, the device being such that, when a constant air pressure, movement of the member in one direction is accompanied by a reduction in the force imparted to the member and movement in the opposite direction is accompanied by an increase in the force, the device having means for connection to an air pressure supply and means for adjusting the level of air pressure so that the force applying member can be set in equilibrium with the tension responsive means at said certain position of the member.

3. A draw-off control system for a roll of material comprising a force generating device having a movable force applying member comprising a chamber across which a diaphragm extends to which the force applying member is connected, one side of the chamber having means for connection to a constant air pressure supply and the other side of the chamber having a convergent wall with which the diaphragm progressively engages from its outer periphery as the diaphragm is deflected into that part of the chamber to reduce progressively the effective area of the diaphragm and therefore the force applied by the diaphragm to the force applying member as the diaphragm is deflected into that part of the chamber and increase the force applied by the diaphragm to the force applying member as the diaphragm disengages from the convergent wall of the chamber, means responsive to tension in the material drawn off from a roll of the material to apply a force in accordance with tension to said member counter to the force generated by the device, means for varying tension in the material drawn off from the roll, a control for the tension varying means operable to increase the tension with movement of the force applying member beyond a certain position in said one direction and operable to reduce tension on movement of the member beyond said certain position in the opposite direction and means to adjust the constant air pressure applied to said one side of the chamber to enable the force applying member to be held in equilibrium between the force generated by the diaphragm and the force applied by the tension responsive means when the force applying member is in said certain position and the material is at the required tension.

4. A system as claimed in any one of claims 1 to 3 wherein the control for the tension increasing/decreasing means comprises an air valve opened by movement of the force applying member through said certain position in one direction and closed by movement of the force applying member in the opposite direction, the air valve controlling the means for increasing/decreasing tension in the material drawn off from the roll.

5. A system as claimed in claim 4 wherein an air pressure supply is connected to the valve and to a control unit for the means to increase/decrease tension, the valve is opened to atmosphere by movement of the force applying member in said one direction beyond the certain position and is closed to maintain air pressure in the circuit when the force applying member moves in the opposite direction beyond said certain position, the control unit being arranged to cause an increase in the tension when air pressure is released from the circuit and to cause a decrease in the tension when air pressure is maintained in the circuit.

6. A system as claimed in claim 5 wherein the means for increasing/decreasing tension in the material drawn off from the roll comprises a pneumatically operated brake for applying a braking force to the rotation of the roll, the brake being connected to a supply of air under pressure through said control units.

7. A control system as claimed in claim 6 wherein means are provided between the control unit and the braking means to dampen any change in the air pressure supplied to the braking means.

8. A control system as claimed in claim 6 wherein the braking means comprise a pneumatically operated disc brake mechanism for braking the rotation of the roll.

9. A control system as claimed in any one of claims 1 to 3 wherein the means for applying a force to the force applying member in accordance with the tension in the material drawn off from the roll comprise a pivotally mounted lever bearing on the force applying member and supporting a roller around which the material from the roll may be passed so that tension in the material draws the lever against the force applying member and applied a counter-force thereby.

10. A system as claimed in claim 9 wherein adjustable stops are provided for limiting the movement of the lever.

11. A system as claimed in claim 9 wherein the lever is pivotally mounted at one end on a fixed mounting, and carries the roller for the material at the other end thereof.

12. A system as claimed in claim 6 wherein an alternative air supply is provided for operating the brake having a pressure regulator for adjusting the pressure thereof to provide the required braking effect and means are provided for switching over from the first mentioned supply to the alternate supply and back again as required.

* * * * *